United States Patent [19]

Baker, III et al.

[11] 4,203,496

[45] May 20, 1980

[54] LONGITUDINAL AXIS ROLLER DRILL BIT WITH GAGE INSERTS PROTECTION

[75] Inventors: William Baker, III, Costa Mesa; Charles R. Harris, Whittier, both of Calif.

[73] Assignee: Smith International, Inc., Newport Beach, Calif.

[21] Appl. No.: 951,978

[22] Filed: Oct. 16, 1978

[51] Int. Cl.[2] ..... E21B 9/08; E21C 13/01

[52] U.S. Cl. ..... 175/329; 175/343; 175/348; 175/374; 175/410

[58] Field of Search ..... 175/329, 343, 348, 374, 175/410, 375

[56] References Cited

U.S. PATENT DOCUMENTS

| | | | |
|---|---|---|---|
| 1,859,948 | 5/1932 | Zublin | 175/348 |
| 2,025,258 | 12/1935 | Zublin | 175/348 |
| 2,704,204 | 3/1955 | Koontz | 175/374 X |
| 4,073,354 | 2/1978 | Rowley et al. | 175/329 |
| 4,096,917 | 6/1978 | Harris | 175/343 X |
| 4,109,737 | 8/1978 | Bovenkerk | 175/410 X |

FOREIGN PATENT DOCUMENTS

| | | | |
|---|---|---|---|
| 2155925 | 2/1973 | Fed. Rep. of Germany | 175/348 |
| 187697 | 12/1966 | U.S.S.R. | 175/343 |

*Primary Examiner*—Ernest R. Purser
*Assistant Examiner*—Nick A. Nichols, Jr.
*Attorney, Agent, or Firm*—Robert M. Vargo

[57] ABSTRACT

A Zublin type rotary drill bit is disclosed having a main body rotating about a main axis. The bit body includes a journl pin extending downwardly therefrom, with the journal pin forming a second axis disposed at an angle with respect to the main axis. The journal pin has a cutter rotatively mounted thereon, with the cutter having a spherical outer surface which has a plurality of inner rows of tungsten carbide mounted thereon. The gage row of the cutter is also formed on the spherical outer surface and defines a plane intersecting the intersection of the main and second axes. The cutter gage row is formed by a plurality of inserts having synthetic diamond cutting surfaces, which are facing downwardly toward the apex of the cutter, in order to scrape the sides of the bore hole during the downwardly traveling portion of the gage insert travel cycle. The cutter also has a heel portion which is located adjacent the backside of the gage inserts for protecting the inserts during the upwardly traveling portion of the gage insert travel cycle.

8 Claims, 4 Drawing Figures

LONGITUDINAL AXIS ROLLER DRILL BIT WITH GAGE INSERTS PROTECTION

BACKGROUND OF THE INVENTION

1. Field of the Invention

The present invention relates generally to rotary drill bits of the Zublin type and more particularly to the cutting structures utilized on these types of bits.

2. Description of the Prior Art

There are various types of rotary drill bits in the well drilling art. One type is the drag bit which comprises a solid head having abrasive cutting elements mounted thereon. As the head is rotated within the bore hole, the cutting elements scrape over the surface of the well formation to remove portions thereof. Drilling fluid is circulated into the well bore to remove the cuttings scraped away by the cutting elements. Conventionally, diamonds have been utilized as the cutting elements mounted on the head, although synthetic diamonds have been used recently.

Another type of rotary drill bit utilized in the well drilling art is the rolling cone type rock bit. Such a bit usually comprises a main bit body having a plurality of legs extending downwardly therefrom. A cone cutter is rotatively mounted on a journal extending radially inward from each of the legs. Each cone cutter has a plurality of tungsten carbide inserts mounted thereon. As the bit is rotated, the cone cutters roll on the bottom face of the bore hole, with the inserts contacting and disintegrating the earth formation. Circulated drilling fluid is also used in these types of bits to remove the cuttings chipped away by the insert elements.

A third type of rotary drill bit is the Zublin type bit in which a cutter is rotatively mounted on an inclined journal pin carried eccentrically by a stem. Instead of rolling on the bore hole face, this eccentricity enables the cutter to travel in a tortuous path in which the cutting elements on the cutter dig away at the bottom of the hole with a combined chipping and scraping action.

Early Zublin type rotary bits exemplified in U.S. Pat. Nos. 1,784,476; 1,859,948; and 1,945,240 had cutting teeth formed on the cone cutter, similar to the milled tooth rolling cone type bits of today. Recently, Zublin type rotary bits have been made with tungsten carbide inserts mounted on the cutters. These bits are described in patents such as the Russian Pat. No. 187,697.

SUMMARY OF THE INVENTION

The present invention improves on the present day Zublin type rotary rock bit by providing a novel type cutting structure never before utilized on such a bit.

Briefly summarizing, the present invention pertains to a Zublin type rotary bit in which the cutter has mounted thereon a plurality of inner rows of tungsten carbide inserts and a gage row of cutting elements having downwardly facing cutting surfaces made of a synthetic diamond material.

It has been found that the synthetic diamond cutting elements operate best in a drag mode, and since the cutting action of the gage row of a Zublin type bit is primarily in this mode, the synthetic diamond cutting elements will greatly enhance the operation of the bit. The rock bit of the present invention will last longer, penetrate faster and operate more efficiently than present day Zublin type rotary bits.

The cutter also has a heel portion extending behind the synthetic diamond cutting elements for protecting the cutting elements during the upwardly moving portion of their travel cycle.

The features of the present invention, which are believed to be novel, are set forth with particularity in the appended claims. The present invention, both as to its organization and manner of operation, together with the further advantages thereof, may best be understood by reference to the following description taken in connection with the accompanying drawings.

DESCRIPTION OF THE PREFERRED EMBODIMENTS

Figure 1:
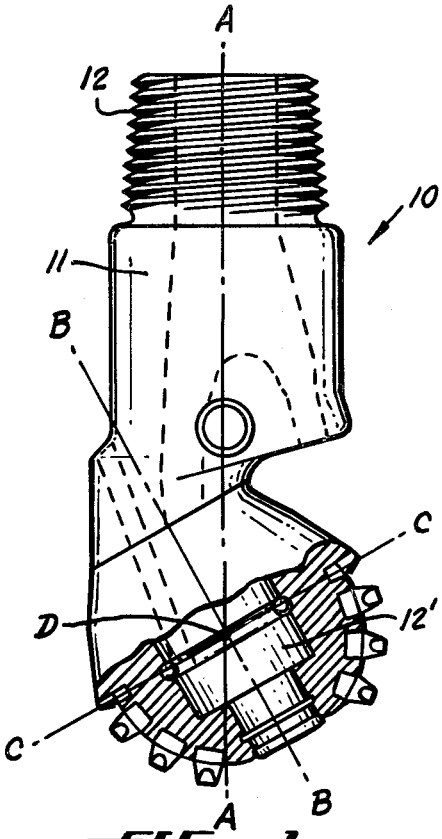
FIG. 1 is a perspective view, partially in section, of a Zublin type rotary drill bit of the present invention.

Referring now to the drawings, FIG. 1 illustrates a Zublin type rotary drill bit, generally indicated by arrow 10, comprising a main bit body 11 having an upper pin portion 12 which is adapted to be threadedly connected to the lower extremity of a drill column (not shown). The drill bit body 11 is adapted to be rotated along with the drill column within a bore hole about a main axis A—A. The lower extremity of the main body 11 includes a journal pin 12' extending downwardly therefrom. The journal pin 12' is oriented eccentrically with respect to the main axis A—A with the journal pin forming a second axis B—B disposed at an angle with respect to the main axis A—A.

Figure 2:
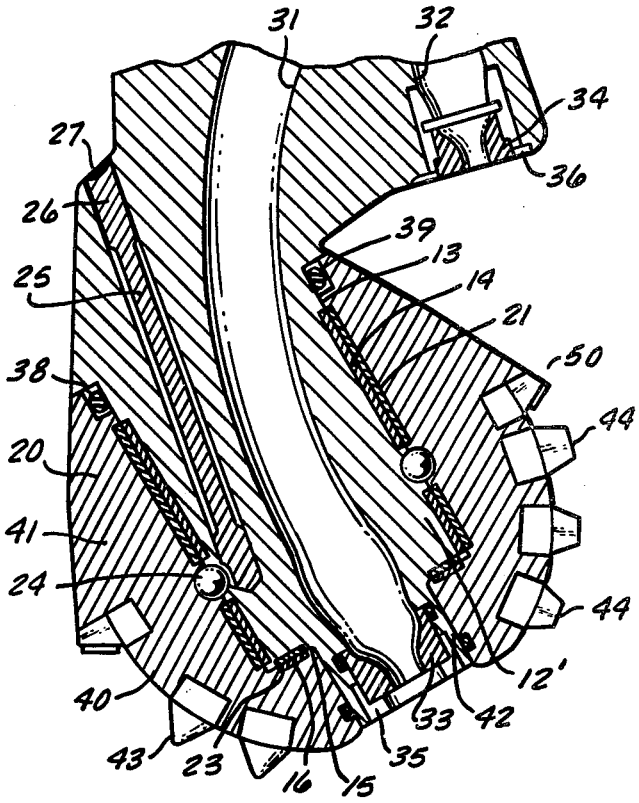
FIG. 2 is an enlarged sectional view of the journal pin-cutter area of the drill bit.

As more clearly shown in FIG. 2, the journal pin 12' includes a cylindrical bearing surface 13 having a quantity of hard facing 14 bonded thereto. The journal pin 12' further includes a thrust surface 15 which includes a hard facing portion 16.

A cutter assembly 20 is rotatably mounted on the journal pin 12' and includes an interior cylindrical cavity having hard faced bearing surfaces 21 and 23 for engaging the cylindrical and thrust bearing surfaces 14 and 16 of the journal pin 12', respectively. The journal pin 12' and cutter assembly 20 also cooperate to form an annular chamber for receiving a plurality of ball bearings 24. During assembly, the cutter 20 is mounted over the journal pin 12' and the ball bearings 24 are inserted into the chamber through a ball hole 25. After the ball bearings 24 are inserted within the groove, the ball hole 25 is closed by a plug 26 which is welded in place at its upper extremity by a weld 27.

The main bit body 11 further includes internal passage ways 31 and 32 for enabling drilling fluid to pass therethrough. Nozzles 33 and 34 are secured at the ends of the passage ways 31 and 32, respectively. Each nozzle 33 and 34 is respectively retained therein by means of a threaded ring 35 and 36. The upper end of the cutter interior further includes a channel 38 for receiving an annular elastomeric seal 39.

Figure 3:
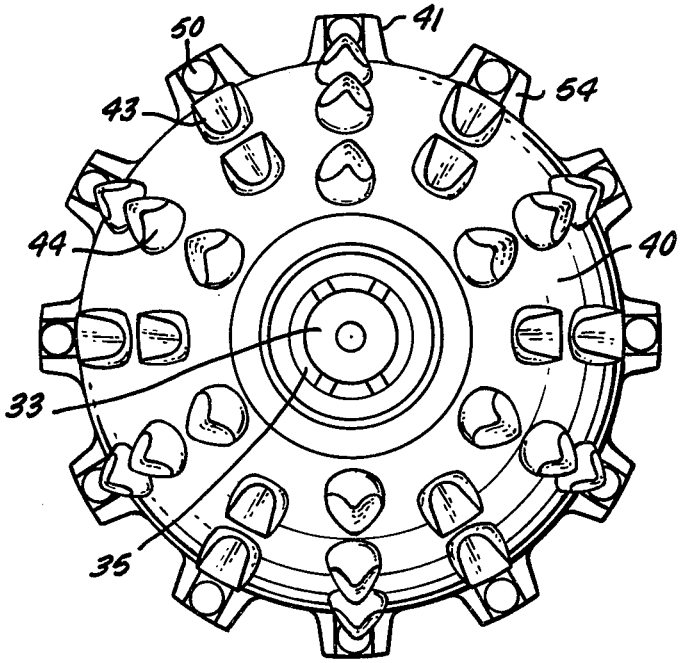
FIG. 3 is a bottom elevational view of the cutter assembly.
Figure 4:
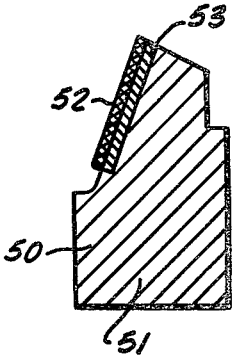
FIG. 4 is a sectional view of one of the gage cutting elements utilized on the cutter assembly.

Referring now more specifically to FIGS. 2 and 3, the cutter 20 includes a substantially spherical portion 40 and a heel or base portion 41. Although other configurations can be utilized for the cutter 20, such as a conical surface, the spherical surface 40 is preferred. The apex of the cutter 20 includes an opening 42 for receiving an extended portion of the journal pin 12' which, in turn, houses the nozzle 33.

A plurality of tungsten carbide inserts 43 and 44 are formed in inner rows on the spherical surface 40 of the cutter 20. It should be noted that the distinction between the inserts 43 and 44 is that they are oriented 90 degrees with respect to each other. A gage row is also formed on the spherical surface 40 which defines a plane C—C which intersects the intersection of the axes A—A and B—B at point D. This gage row includes a plurality of cutting elements 50 which comprises a base portion 51 supporting a cutting surface 52 made of synthetic diamond material and a substrate 53 of tungsten carbide. The cutting elements 50 are oriented on the gage row in such a manner that the cutting surfaces 52 of the synthetic diamond material face downwardly. The base or heel portion 41 of the cutter 20 includes raised portions 54 which extend directly behind and partially around each of the cutting elements 50. One type of synthetic diamond material is manufactured by General Electric Corporation under the trademark "STRATAPAX".

During the operation of the drill bit 10, the main bit body 11 is rotated about axis A—A while the cutter 20 rotates about axis B—B. Because of the relative sizes, the cutter 20 makes approximately two revolutions for each three revolutions of the main bit body 11. Because of the eccentricities involved, the inserts 43 and 44 and the cutting elements 50 have a circuitous path of travel. In fact, the cutting elements 50 include a large amount of vertical travel as the cutter 20 is rotated. During the cutting portions of the cycle, the cutting elements 50 travel downwardly to enable the cutting surfaces 52 to scrape along the side of the bore hole to define the gage of the bore hole. During the upward travel of the cutting elements 50 the raised heel portions 54 function to protect the cutting elements 50 during this upward travel. The inserts 43 and 44 function to scrape and chip away at the formation at the bore hole bottom. The drilling fluid passing through nozzles 33 and 34 functions to carry the cuttings away from the bottom of the hole.

As can be seen, a rotary drill bit of the Zublin type is provided with the novel combination of cutting elements which enable it to outperform similar types of drill bits having conventional cutting structures.

It should be noted that various modifications can be made to the assembly while still remaining within the purview of the following claims.

What is claimed is:

1. A rotary bit for drilling wells comprising:

a bit body rotatable about a first axis, said bit body adapted to be secured to a drill column, said bit body further including a journal pin extending downwardly therefrom, said journal pin having a second axis disposed at an angle with respect to and intersecting said first axis; and a cutter rotatively mounted on said journal pin to rotate about said second axis, said cutter having an outer surface extending from an apex to an annular gage surface, said gage surface terminating adjacent a base or heel portion of said cutter, said gage surface oriented in such a manner that a plane extending therethrough intersects the point of intersection of the first and second axes, said gage surface having a plurality of cutting elements mounted thereon, each cutting element comprising a cutting surface made of a synthetic diamond material mounted on a base, said cutter further includes raised areas formed on said base or heel portion substantially around the back portions of said cutting elements in order to protect said cutting elements during the non-cutting cycle of the cutting elements

2. The combination of claim 1, wherein each of said cutting elements further includes a substrate of tungsten carbide positioned between said cutting surface and said base.

3. The combination of claim 1, wherein each of said cutting surfaces faces substantially in the direction of said second axis.

4. The combination of claim 1, wherein said cutter outer surface is substantially spherical in shape.

5. The combination of claim 1, wherein said cutter outer surface has a second plurality of cutting elements mounted thereon.

6. The combination of claim 5, wherein said second plurality of cutting elements comprise tungsten carbide inserts.

7. The combination of claim 6, wherein said inserts are chisel crested.

8. The combination of claim 8, wherein a portion of said inserts have their cutting faces oriented ninety degrees to the cutting faces of the rest of the inserts.

* * * * *